US006146157A

United States Patent [19]

Lenoir et al.

[11] Patent Number: 6,146,157

[45] Date of Patent: Nov. 14, 2000

[54] CONNECTOR ASSEMBLY FOR PRINTED CIRCUIT BOARDS

[75] Inventors: Michel Lenoir, Montfort le Gesnois; Jacky Thenaisie; Michel Fonteneau, both of Le Mans, all of France

[73] Assignee: Framatome Connectors International, Courbevoie, France

[21] Appl. No.: 09/108,547

[22] Filed: Jul. 1, 1998

[30] Foreign Application Priority Data

Jul. 8, 1997 [FR] France ..... 97 08832

[51] Int. Cl.[7] ..... H01R 4/66; H01R 13/648

[52] U.S. Cl. ..... 439/101; 439/607; 439/497

[58] Field of Search ..... 439/607–610, 439/78, 83, 101, 108, 92, 95, 497

[56] References Cited

U.S. PATENT DOCUMENTS 5,169,324 12/1992 Lemke et al. ..... 439/101
5,174,770 12/1992 Sasaki et al. ..... 439/108
5,577,935 11/1996 Harting et al. ..... 439/851

FOREIGN PATENT DOCUMENTS

0486298 A1 5/1992 European Pat. Off. .
3511344 A1 10/1986 Germany .

OTHER PUBLICATIONS

French Search Report Mar. 17, 1998.

*Primary Examiner*—Lincoln Donovan
*Attorney, Agent, or Firm*—Perman & Green, LLP

[57] ABSTRACT

A connector assembly for printed circuit boards comprises a first connector having a first housing of insulating material and a plurality of male signal and ground contacts regularly arranged in rows and columns. The connector assembly further comprises a second connector having a second housing of insulating material and a plurality of female signal and ground contacts regularly arranged in rows and columns. In each row and each column of both connectors all contacts are arranged at an equal pitch in row and column direction, each row of contacts containing only signal or only ground contacts, respectively. The rows of ground contacts are staggered in row direction by half the pitch of the contacts. Four rows of signal contacts and four rows of ground contacts are provided. Both outer rows of contacts contain signal contacts and a further row of ground contacts is provided centrally between the two central rows of signal contacts. The ground contacts of said further row of ground contacts each lie in a column of signal contacts.

4 Claims, 5 Drawing Sheets

CONNECTOR ASSEMBLY FOR PRINTED CIRCUIT BOARDS

BACKGROUND OF THE INVENTION

The invention relates to a connector assembly for printed circuit boards, comprising a first connector having a first housing of insulating material and a plurality of male signal and ground contacts regularly arranged in rows and columns, and a second connector having a second housing of insulating material and a plurality of female signal and ground contacts regularly arranged in rows and columns, wherein in each row and each column all contacts are arranged at an equal pitch in row and column direction, each row of contacts containing only signal or only ground contacts, respectively, wherein the rows of ground contacts are staggered in row direction by half the pitch of the contacts, wherein four rows of signal contacts and four rows of ground contacts are provided.

EP-A-0 486 298 discloses a connector assembly of this type. In this known connector assembly the contacts are arranged in such a manner that each single signal contact is surrounded by ground contacts.

The invention aims to provide an improved connector assembly of the above-mentioned type.

According to the invention the connector assembly is characterized in that both outer rows of contacts contain signal contacts and in that a further row of ground contacts is provided centrally between the two central rows of signal contacts, the ground contacts of said further row of ground contacts each lying in a column of signal contacts.

In this manner a twinax arrangement of signal contacts is obtained with improved shielding of the signal contacts.

The invention will be further explained by reference to the drawings in which an embodiment of the connector assembly according to the invention are shown.

DETAILED DESCRIPTION OF THE PREFERRED EMBODIMENT

Figure 1:
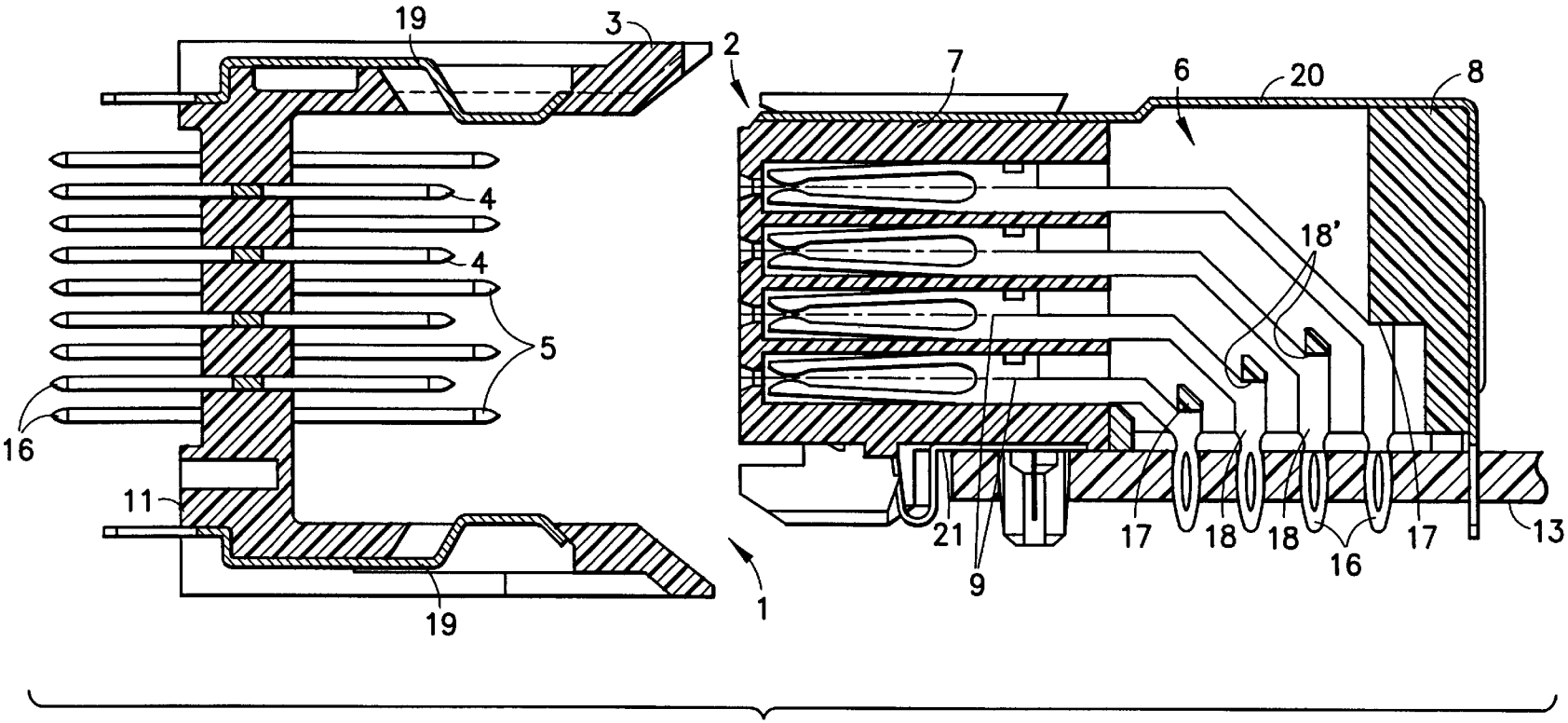
FIG. 1 shows a cross-section through a column of signal contacts of a connector assembly to explain the general background of the invention, wherein the connectors are disconnected.

Referring to FIGS. 1–4 there is shown a first embodiment of a connector assembly for printed circuit boards, comprising a first or male connector 1 and a second or female connector 2. The male connector 1 comprises a first housing 3 of insulating material and a plurality of male signal contacts 4 and a plurality of male ground contacts 5. In the embodiment shown the length of the ground contacts 5 is greater than the length of the signal contacts 4. However the signal and ground contacts may have equal lengths.

The female connector 2 comprises a second housing 6 of insulating material which is an assembly of a front housing 7 and a rear housing 8. Further the female connector 2 comprises a plurality of female signal contacts 9 and a plurality of female ground contacts 10.

Figure 2:
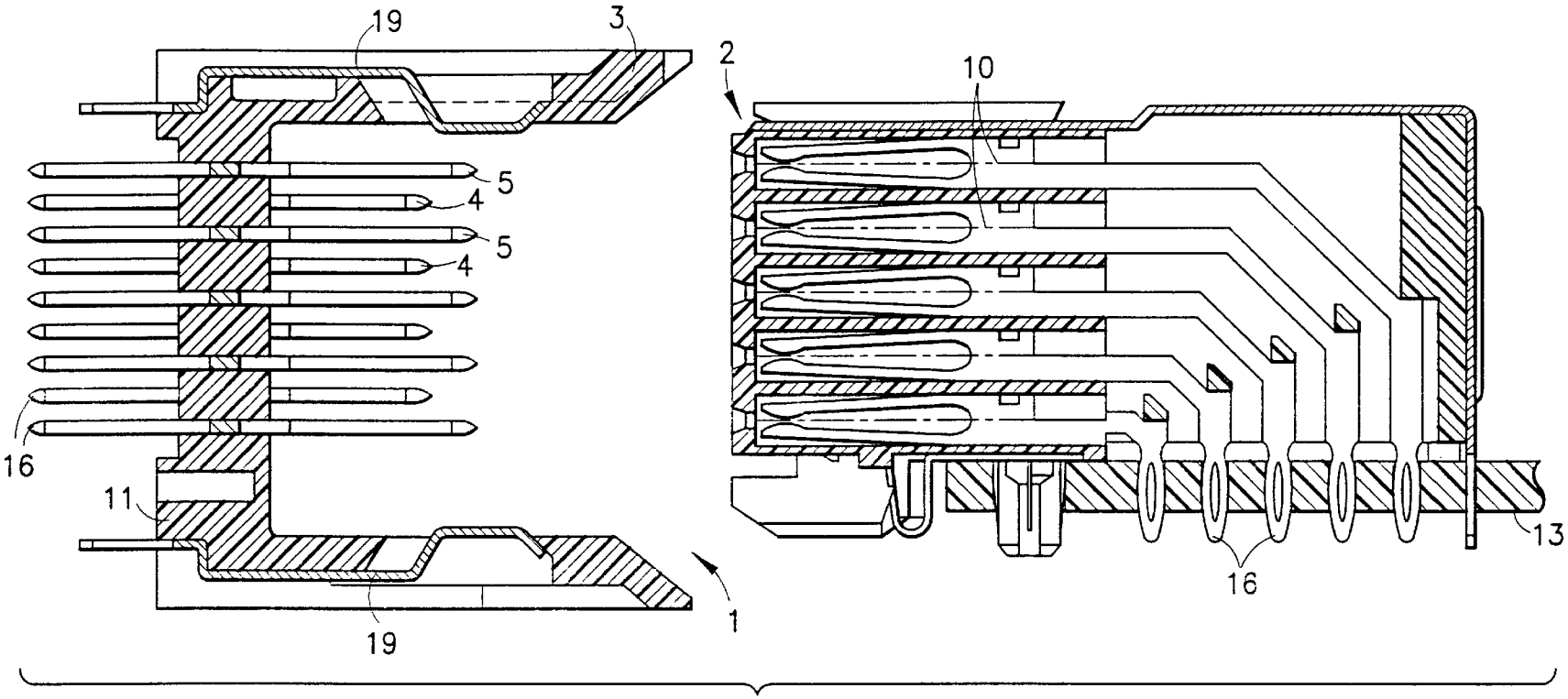
FIG. 2 shows a cross-section through a column of ground contacts of the connector assembly according to FIG. 1.
Figure 3:
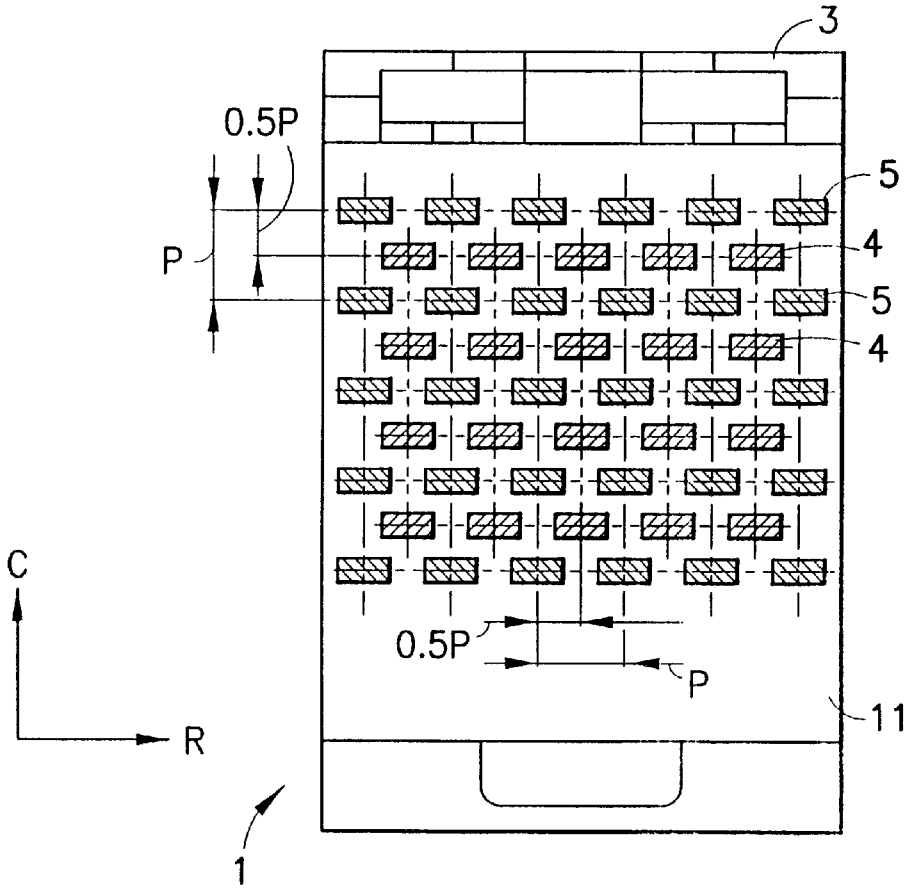
FIG. 3 is a top view of the male connector of the connector assembly of FIG. 1.
Figure 4:
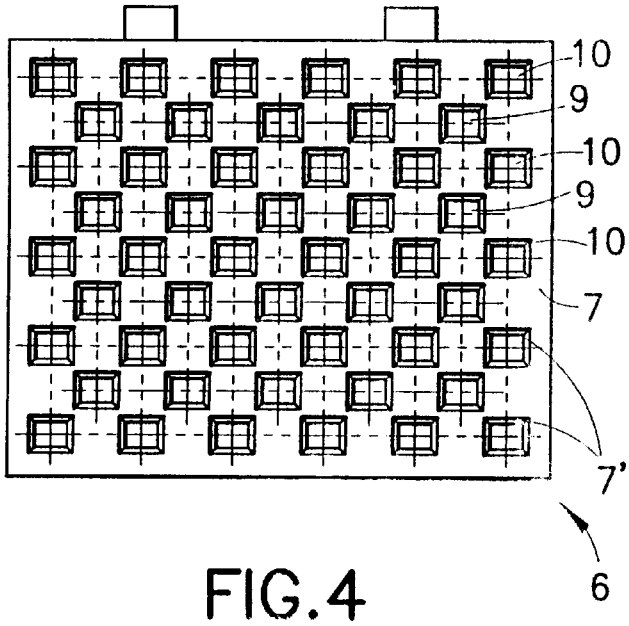
FIG. 4 is a front view of the female connector of the connector assembly of FIG. 1.
Figure 5:
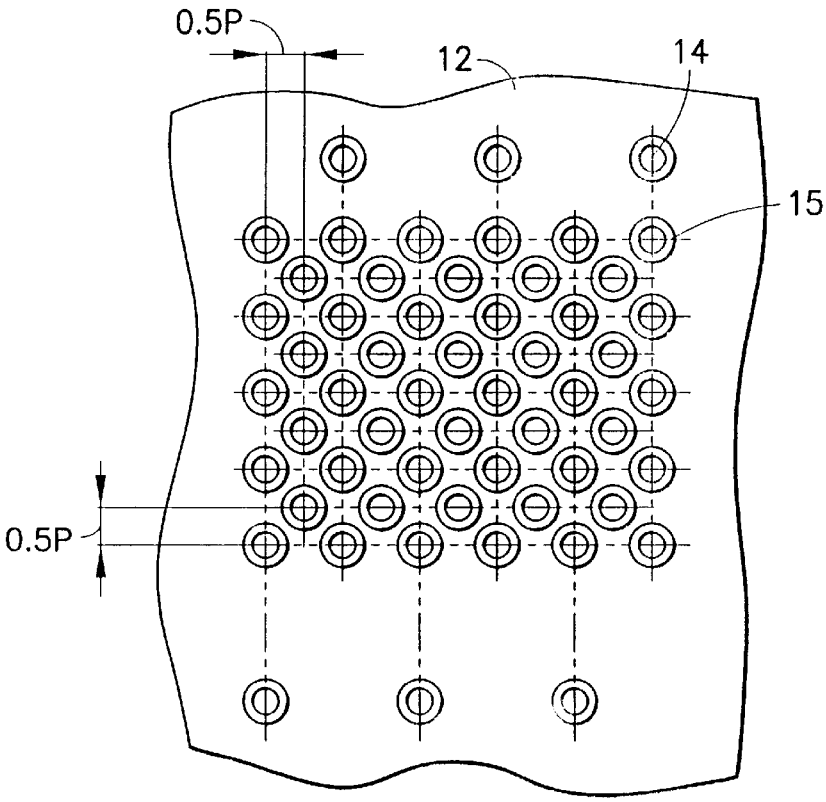
FIGS. 5 and 6 show the layout of a printed circuit board for the male and female connectors of the connector assembly of FIG. 1.
Figure 6:
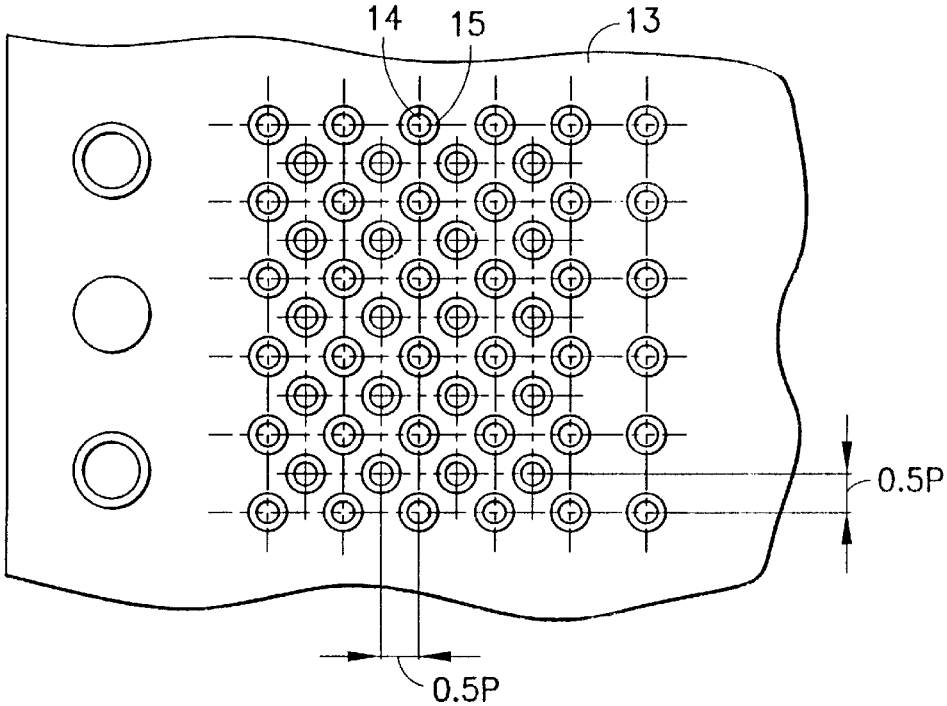

In order to increase the density of contacts, the signal and ground contacts 4, 5 and 9, 10 are arranged in a special manner as can be seen in FIGS. 3–6 in particular. FIG. 3 is a top view of the male connector 1 wherein the signal and ground contacts 4, 5 are indicated by a different shading wherein the dimensions of the contacts 4, 5 are shown at the height of a bottom 11 of the housing 3. FIGS. 5 and 6 show by way of example the layout of a printed circuit board 12 for the male connector 1 and 13 for the female connector 2, respectively. The printed circuit board 13 for the female connector 2 is also schematically shown in FIGS. 1 and 2. From these drawings it will be clear that all contacts are regularly arranged in rows r and columns c, wherein in each row and column all contacts 4, 5 and 9, 10 are arranged at an equal pitch p in row and column direction. This pitch p can be 2 mm, for example. Further, each row and each column of signal contacts 4 or 9 contains signal contacts only and each row and each column of ground contacts 5 or 10 contains ground contacts only. As can be seen especially in FIG. 3, successive rows of contacts 4, 5 are staggered in row direction by half the pitch p of the contacts, wherein the rows and columns of contacts have a pitch equal to half the pitch p of the contacts. In this manner a pitch ½p of the contacts 4, 5 and 9, 10 in adjacent rows and columns can be obtained. At a pitch=2 mm, the pitch between adjacent contacts 4, 5 and 9, 10 will be 1 mm. This pitch ½p can be less than half the dimension of the male contacts 4, 5 in row direction at the location of the bottom 11 of the male housing 3, so that the contacts can be arranged at a smaller pitch than the dimensions of the male contacts would allow at a conventional arrangement. Further, FIGS. 5 and 6 show that the density of the contacts can be increased such that the pitch ½p in row and column direction between the holes 14 in the printed circuit boards 12, 13 can be equal or even less than the diameter of the plated area 15 around each of the holes 14.

Preferably the outer rows and outer columns of contacts are ground contacts as shown in FIG. 3.

As shown in FIG. 4 in a front view of the front housing 7 the female connector 2, the entrance openings 7' for the male contacts 4, 5 can have dimensions at the entrance side which are almost equal or even greater than the pitch between the contacts of adjacent rows and columns.

In the embodiment of the connector assembly of FIGS. 1–6, all male and female contacts are provided with press-fit terminations 16 for connection to the plated through-holes 14 of the corresponding printed circuit boards 12, 13. In the female connector 2, the rear housing 8 is provided with support shoulders 17 cooperating with rear sections 18 of the female signal and ground contacts 9, 10. These rear sections 18 are provided with two bends of approximately 45°, wherein the shoulder 17 is located at the first bend as seen from the press-fit termination 16. In the embodiment of FIGS. 1–6, the rear sections 18 are provided with recesses 18' for engaging the shoulders 17. In this manner the forces applied to the rear sections 18 of the female contacts 9, 10 are exerted on the shoulders 17 of the rear housing 8 so that no deformation of the female contacts 9, 10 can occur during insertion of the press-fit terminations 16 into the through-holes 14 of the printed circuit board 13.

In the embodiment shown in FIGS. 1 and 2, the male connector 1 is provided with shielding plates 19 and the female connector 2 is provided with an upper shielding plate 20 and a lower shielding plate 21. The upper shielding plate 20 provides for the mutual fixation of the front and rear housings 7, 8.

Figure 7:
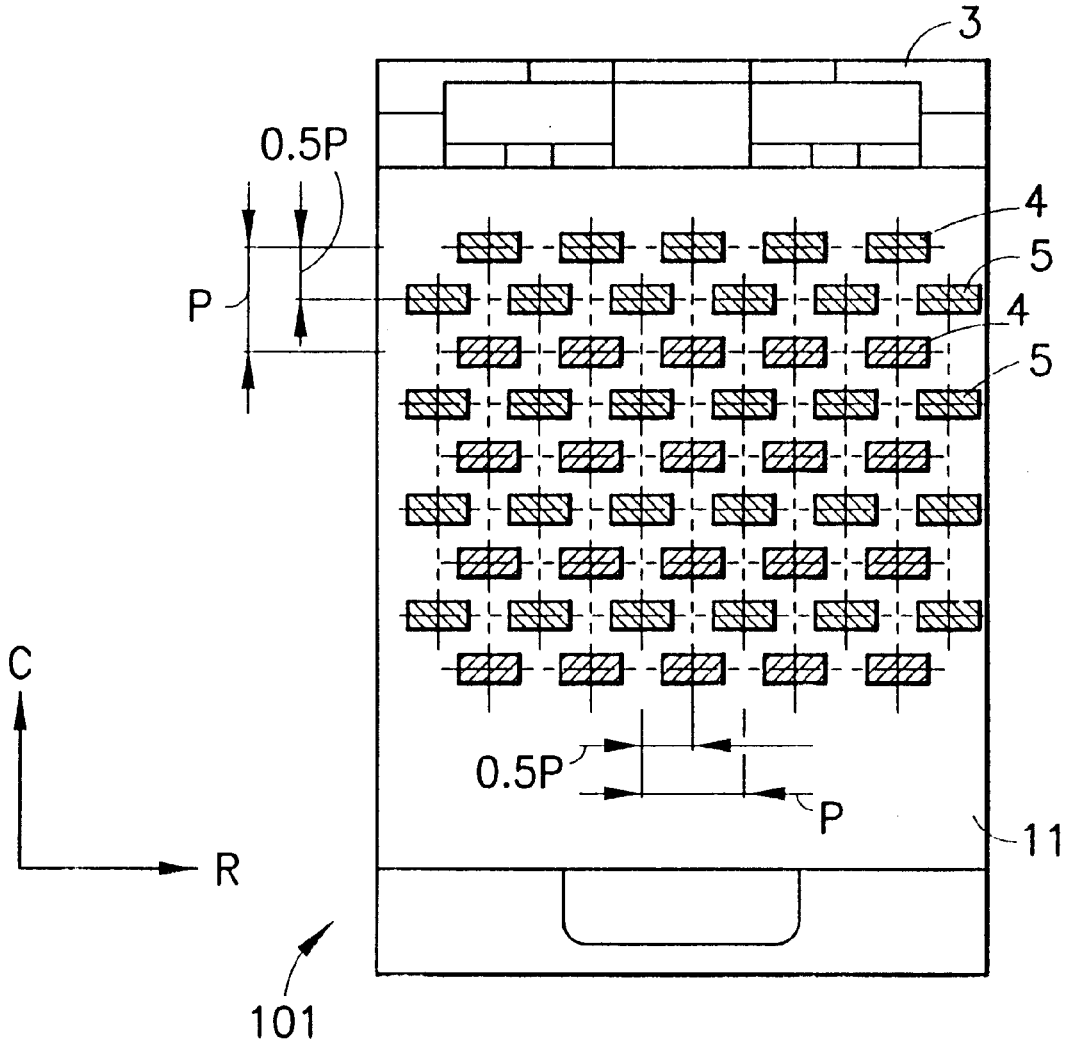
FIG. 7 shows a top view of the male connector of an embodiment of the connector assembly according to the invention.

FIG. 7 shows a top view of a male connector 101 which is mainly made in the same manner as the male connector 1 shown in FIGS. 1–4, wherein corresponding parts are indicated by the same reference numerals. In this case the outer rows of contacts are signal contacts 4 and the outer columns of contacts are still ground contacts 5. In this male connector 101, the contacts of the central row lying in the columns of signal contacts 4 are ground contacts 5. Therefore each column of signal contacts 4 comprises two signal contacts 4 above and below the central ground contact 5. In this manner a contact arrangement of signal contacts 4 shielded by ground contacts 5 is obtained in the male connector 101 and, of course, also in the corresponding female connector not shown equivalent to a twin-ax arrangement.

It will be understood that the invention is not restricted to the above-described embodiments which can be varied in a number of ways within the scope of the claims.

What is claimed is:

1. Connector assembly for printed circuit boards, comprising:

a first connector having a first housing of insulating material and a plurality of male signal and ground contacts regularly arranged in rows and columns, a second connector having a second housing of insulating material and a plurality of female signal and ground contacts regularly arranged in rows and columns, each row of contacts being arranged so that the contacts are at an equal pitch in a row direction relative to those like contacts in each respective row, and each row of contacts containing only signal or ground contacts, respectively, said first and second connectors having at least four rows of signal contacts and at least four rows of ground contacts, with the contacts in each respective row being staggered relative to the contacts in an adjacent row by half of the pitch of the contacts, the outer rows of contacts comprising signal contacts, and a further central row of ground contacts being positioned between two central rows of signal contacts, with the ground contacts of said central row lying in the columns defined by the signal contacts rather than the columns defined by the ground contacts of ground contact rows other than the central row.

2. Connector assembly according to claim 1, wherein both outer columns of contacts contain ground contacts.

3. Connector assembly according to claim 1, wherein the pitch of the contacts in adjacent rows and columns is less that twice the dimension of the male contacts in row direction at the height of the bottom of the first housing.

4. Connector assembly according to claim 1, wherein the second housing is provided with a front side having a grid of entrance openings for the male contacts, wherein at least at the entrance side, the dimension of the entrance openings in row direction is greater than the pitch of the rows and columns of contacts.

* * * * *